US009945554B2

(12) United States Patent
Weigold et al.

(10) Patent No.: US 9,945,554 B2
(45) Date of Patent: Apr. 17, 2018

(54) METHOD OF STEAM GENERATION BY SPRAYING WATER ONTO A DUCT WITHIN A CHAMBER HAVING DIVIDER WALLS

(71) Applicant: Laurie Davies, Winnipeg (CA)

(72) Inventors: Theodore S. Weigold, Boise, ID (US); Shane M. Touchette, Boise, ID (US)

(73) Assignee: Tinman Inc., Garden City, ID (US)

( * ) Notice: Subject to any disclaimer, the term of this patent is extended or adjusted under 35 U.S.C. 154(b) by 535 days.

(21) Appl. No.: 13/651,985

(22) Filed: Oct. 15, 2012

(65) Prior Publication Data

US 2013/0276448 A1 Oct. 24, 2013

Related U.S. Application Data

(60) Provisional application No. 61/546,952, filed on Oct. 13, 2011.

(51) Int. Cl.
*F22B 27/16* (2006.01)
*F22B 37/60* (2006.01)
(Continued)

(52) U.S. Cl.
CPC ..... *F22G 7/14* (2013.01); *B01B 1/06* (2013.01); *F01K 23/065* (2013.01); *F01K 23/10* (2013.01);
(Continued)

(58) Field of Classification Search
CPC ..... F01K 25/10; F01K 23/065; F01K 23/10–23/105; F02C 7/222; F02C 7/228;
(Continued)

(56) References Cited

U.S. PATENT DOCUMENTS 1,775,939 A * 9/1930 Matthaei ..... B60H 1/00335 165/155
2,752,128 A * 6/1956 Dedo ..... F28D 7/10 165/154
(Continued)

FOREIGN PATENT DOCUMENTS

DE 2946447 5/1981
FR 2287648 A1 * 5/1976 ..... F22B 7/02
(Continued)

*Primary Examiner* — Laert Dounis
(74) *Attorney, Agent, or Firm* — Adrian D. Battisor; Ade & Company Inc.; Kyle R. Satterthwaite

(57) ABSTRACT

Liquid is flash evaporated in a series of cells along and surrounding an exhaust duct to generate a pressurized vapor where at least one of the surfaces is in communication with the source of heat sufficient to maintain the surface at a temperature such that the liquid injected into the chamber is substantially instantly converted to a superheated vapor with no liquid pooling within the chamber. The liquid is introduced by controlled injectors operating at a required rate. Each of the cells is periodically discharged by a pressure controlled relief valve and the vapor from the cells combined to form a continuous stream feeding a turbine or other energy conversion device. The outer wall of the cell is offset so that it contacts the inner wall at one point around the periphery. Heat transfer ribs and bars can be provided in the duct to provide increased heat transfer where necessary.

10 Claims, 4 Drawing Sheets

(51) Int. Cl.

| | |
|---|---|
| ***F28D 7/10*** | (2006.01) |
| ***F01K 23/06*** | (2006.01) |
| ***F22G 7/14*** | (2006.01) |
| ***F28F 1/40*** | (2006.01) |
| ***B01B 1/06*** | (2006.01) |
| ***F01K 23/10*** | (2006.01) |
| ***F28D 21/00*** | (2006.01) |
| *F01N 5/02* | (2006.01) |

(52) U.S. Cl.
CPC ..... *F22B 27/16* (2013.01); *F22B 37/60* (2013.01); *F28D 7/10* (2013.01); *F28D 21/001* (2013.01); *F28F 1/40* (2013.01); *F01N 5/02* (2013.01)

(58) Field of Classification Search
CPC ..... F02C 7/232; F02M 41/06; F02M 59/00; F22B 1/287; F22B 1/288; F22B 3/04; F24H 1/142; F24H 1/162; F28D 7/10; F28D 7/103; F28D 7/106
USPC ..... 60/648; 62/116, 510; 122/40, 242; 137/118.02, 565.27; 392/399, 481
See application file for complete search history.

(56) References Cited

U.S. PATENT DOCUMENTS

| | | | | | |
|---|---|---|---|---|---|
| 2,790,428 | A * | 4/1957 | Buttler | F22B 3/06 | 122/134 |
| 2,986,907 | A * | 6/1961 | Hoop | 62/510 | |
| 3,119,004 | A | 1/1964 | Hoop | | |
| 3,238,902 | A * | 3/1966 | Escher | C21B 9/10 | 110/304 |
| 3,453,840 | A * | 7/1969 | Iyoshi | F24F 3/001 | 165/154 |
| 4,479,359 | A * | 10/1984 | Pelloux-Gervais | F17C 9/02 | 165/133 |
| 4,497,365 | A * | 2/1985 | Boyer | F28D 7/106 | 165/154 |
| 4,901,531 | A * | 2/1990 | Kubo | F01K 23/065 | 60/618 |
| 4,938,173 | A * | 7/1990 | Hopkinson | F22B 35/005 | 122/40 |
| 6,688,138 | B2 * | 2/2004 | DiFlora | F28D 1/0535 | 62/509 |
| 6,834,503 | B2 | 12/2004 | Freyman | | |
| 7,520,133 | B2 | 4/2009 | Hoetger | | |
| 2009/0282827 | A1 | 11/2009 | Badua | | |
| 2010/0083658 | A1 | 4/2010 | Walpita | | |
| 2011/0056198 | A1 | 3/2011 | Flakus | | |
| 2011/0067839 | A1 * | 3/2011 | Norton | B64D 13/00 | 165/104.12 |
| 2011/0259553 | A1 * | 10/2011 | Filippone | F01N 5/02 | 165/104.21 |
| 2012/0222845 | A1 * | 9/2012 | Kinder | F28F 13/12 | 165/154 |
| 2012/0240868 | A1 * | 9/2012 | Sumi | F24H 9/0026 | 122/13.01 |

FOREIGN PATENT DOCUMENTS

| | | | | |
|---|---|---|---|---|
| GB | 304588 | | 1/1930 | |
| GB | 304588 | A * | 1/1930 | F22B 27/14 |
| WO | 8804390 | | 6/1988 | |
| WO | WO2004018936 | | 3/2004 | |
| WO | WO2007114589 | | 10/2007 | |

* cited by examiner

METHOD OF STEAM GENERATION BY SPRAYING WATER ONTO A DUCT WITHIN A CHAMBER HAVING DIVIDER WALLS

This application claims the benefit under 35 USC 119 (e) of Provisional Application 61/546,952 filed Oct. 13, 2011, the disclosure of which is incorporated herein by reference.

This invention relates to an apparatus for vaporization which can be used for example in a Rankine cycle engine to generate power from waste heat using a turbine. Such waste heat is often available from the exhaust gases of various combustion systems, such as internal combustion engines or furnaces, but other sources of heat can be used. In addition other uses of the vaporized gas, typically steam, are possible

BACKGROUND OF THE INVENTION

However there remains difficulty in providing a heat exchanger which extracts heat at a suitable efficiency to make this system operate effectively. Typical heat exchanger use tubes often with fins to transfer heat from the heating medium into liquid carried within the tube so that the liquid in the tube evaporates and discharges as steam at the remote end of the tube.

SUMMARY OF THE INVENTION

It is one object of the invention to provide an improved method for evaporating liquid to generate vapour typically but not necessarily to be used to drive a turbine.

According to a first aspect of the invention there is provided a method for evaporating a liquid to generate a pressurized vapor comprising:

providing a cell including walls defining two spaced surfaces with an open chamber therebetween;

injecting the liquid into the chamber;

the walls being in communication with a source of heat sufficient to maintain the surfaces at a temperature such that the liquid injected into the chamber is substantially instantly converted to a superheated vapor with no liquid pooling within the chamber;

providing an outlet from the cell for the vapor to escape.

Preferably the temperature in the cell is greater than 250 degrees F. so as to generate superheated vapor instantly. In addition the temperature is maintained well above 212 degrees F. in order to avoid the heat loss which occurs in the in lines to turbine causing undesirable condensation.

Preferably the pressure in the cell is maintained greater than 40 psi, preferably greater than 50 and preferably greater than 100 psi.

Preferably the liquid flow is controlled by an injector at a pressure greater than the relief pressure.

Preferably the injector has a frequency of injection which is controlled to provide a required quantity of liquid.

Preferably there is provided a relief valve downstream of the outlet which acts to maintain the pressure.

Preferably the relief valve opens and closes at a rate to maintain the pressure between an upper value when the valve opens and a lower value when the valve closes.

Preferably the relief valve is arranged to control release pressure and temperature in the cell so that no liquid is present in the cell.

Preferably there is provided a plurality of cells, the output of which is connected together.

Preferably each cell has a back pressure valve which operates at a rate determined by the pressure in the cell to generate periodic bursts of vapor and the output from the cells is collected to form a continuous stream.

Preferably at least some of the cells are arranged sequentially along a source of heat Preferably the source of heat comprises a multiple cylinder internal combustion engine with a plurality of exhaust ducts and wherein there is provided a plurality of cells arranged sequentially on each exhaust duct.

Preferably the input liquid flow is controlled by injectors where each injector supplies liquid to a plurality of cells at common position on the ducts.

Preferably there are provided elements for controlling heat transfer from the duct to each cell wherein the elements are arranged so as to increase heat transfer to subsequent cells on same exhaust duct.

Preferably the input liquid flow is controlled by injectors where each injector supplies liquid to one or more cells and is controlled by an engine control computer to supply liquid at a rate dependent on engine parameters.

Preferably the cell includes an inner wall defining a duct though which heated gases pass and an outer wall surrounding the inner wall to define a chamber therebetween.

Preferably the liquid is injected from a nozzle at the outer wall onto the inner wall Preferably the outlet for the vapor is provided in the outer wall.

Preferably the outer wall is axially offset from the inner wall so that an inside surface of the outer wall is in contact with an outside surface of the inner wall at one side of the inner and outer walls.

Preferably there is provided a plurality of cells in a row and the outer wall of one cell is divided from the outer wall of the next by a crescent shape divider.

Preferably there are provided elements within the duct and inside the inner wall for controlling heat transfer from the gas in the duct to and through the inner wall.

Preferably the elements within the duct comprise fins mounted on the inner wall and extending inwardly therefrom.

Preferably the elements within the duct comprise bars bridging the duct and connected at each end to the inner wall.

Preferably there is provided at least one fin interconnecting the bars.

According to a second aspect of the invention there is provided a method for evaporating a liquid to generate a pressurized continuous stream of vapor comprising:

providing a plurality of cells each having a surface in contact with a source of heat;

injecting the liquid into each of the cells;

wherein each cell has a back pressure valve which opens and closes at a rate determined by the pressure in the cell to generate periodic bursts of vapor;

and commonly collecting the output from at least some of the cells to form a continuous stream.

According to a third aspect of the invention there is provided a method for evaporating a liquid to generate a pressurized continuous stream of vapor comprising:

providing at least one duct through which heated gases from a heat source pass;

providing a series of cells along the duct, each cell having an inner wall defining the duct though which the heated gases pass and an outer wall surrounding the inner wall to define a chamber therebetween;

injecting the liquid into each of the cells so as to be applied onto the inner surface so as to flash into vapor;

and collecting the output from at least some of the cells to form a stream;

and wherein the outer wall is axially offset from the inner wall so that an inside surface of the outer wall is in contact with an outside surface of the inner wall at one side of the inner and outer walls.

Preferably the outer wall of one cell of the series of cells is divided from the outer wall of the next by a crescent shape divider.

According to a fourth aspect of the invention there is provided a method for evaporating a liquid to generate a pressurized continuous stream of vapor comprising:

providing at least one duct through which heated gases from a heat source pass;

providing a series of cells along the duct, each cell having an inner surface defined by the duct and on outer surface surrounding the duct;

injecting the liquid into each of the cells so as to be applied onto the inner surface so as to flash into vapor; and collecting the output from at least some of the cells to form a stream;

wherein there are provided elements within the duct and inside the inner wall for controlling heat transfer from the gas in the duct to the inner wall.

Preferably the elements within the duct comprise fins mounted on the inner wall and extending inwardly therefrom.

Preferably the elements within the duct comprise bars bridging the duct and connected at each end to the inner wall.

Preferably there is provided at least one helical fin interconnecting the bars.

The key point therefore is that the cell causes very rapid, essentially instantaneous, simultaneous flash evaporation of the liquid to form the gas. In order to achieve this, the temperature of the cell cannot be allowed ever to drop so that the flash evaporation halts and liquid is allowed to pool. The liquid is thus fed into the cell throughout the cell rather than at one end. The system is designed so that the amount of heat from the heat source is matched to the liquid injection so that maximum heat is extracted while no part of the cell is cooled to a temperature so that flash evaporation halts at that area.

The liquid is typically water but other liquids can be used where their characteristics are more suitable for the end use intended.

The shape of the cell can vary widely since the shape has little effect on the operation within the cell which is controlled by the back pressure on the cell and the injection of the liquid in small streams or squirts of additional liquid into the pressurized super-heated vapor within the cell. The surfaces can be parallel so that the distance is constant and the liquid is sprayed from one surface toward the other, but again this is not essential. This allows the heat to reach from the surfaces to the interior of the cell to provide the flash evaporation. The distance between the surfaces can also vary widely and for example they could be shaped so that they are grooved or scalloped thereby optimizing contact area with a heat source. In other words, there are ways to increase surface area within the cell, thereby increasing steam production and controlling/influencing the rate of heat transfer.

The cells are arranged preferably end to end surrounding a heat source. However other arrangements are possible and the heat source may be arranged to pass between two cells or two or more of the cells can be stacked one on top of another. Various arrangements can be provided as required to extract maximum heat from the source.

Preferably the liquid is injected at a single location in the cell by a single injector. However in some cases additional injectors can be provided at different locations within the cell so that the whole cell is used to generate the steam.

For this purpose, the liquid can be injected through one surface or both surfaces or along edges of the cell again with the intention that the whole cell is used.

In some cases such as for an exhaust manifold, the cell is formed by casting so that one wall is formed by the manifold itself while the other wall defining the second surface is formed as a spaced covering layer. In this way a cast manifold, incorporating a cell, can be shaped to precisely and uniformly match the existing manifold to avoid interfering with its design or function and the resulting cast manifold includes the outer layer which defines the cell as an additional layer or shell. In some cases the gas flows in the manifold are unchanged by fins or other obstructions which could interfere with the proper operation of the engine or other construction/source which produces the heat. Thus, in one example the first surface is cylindrical. However in some cases, fins, bars and other designs of obstruction can be used to aid transfer of heat to the inner wall surrounding the duct. In this case the shape and design of the manifold may need to be changed to accommodate the obstructions, which can interfere with exhaust flow, to avoid an unacceptable increase in back pressure at the exhaust ports.

Typically one or where possible both walls are directly in contact with the heat source. That is the wall is relatively thin and has an outer surface directly in engagement with the heat so that the heat directly transfers by conduction through the thin wall to the surface of the cell. That is there no fins on the walls so that the walls are directly in contact with the heat source. Typically the walls in contact with the heat source form smooth surfaces.

Preferably to achieve the continuous simultaneous instantaneous flash evaporation, the temperature in the cell is greater than 250 degrees F. Thus one surface is defined by a wall heated by direct contact with gas at high temperature much greater than 212 degrees F. and preferably greater than 450 degrees F. When used with automotive exhaust systems, the gas temperature can be 1400 to 1500 and as much as 1800 which is in the range of the optimum operational heat in diesel engine exhaust, for example, and the method anticipates use in such applications. The highest useable temperature in other gases can be much higher. Higher temperatures will permit injection of much greater volumes of water resulting in proportionally greater volumes of steam.

The pressure in the cell is typically greater than 40 psi, preferably greater than 50 and preferably of the order of 100 psi. The ultimate maximum operating pressure is potentially much higher and can be as much as 300 psi. It can be optimized in anticipation of use in a variety of internal combustion exhaust gas applications or to suit use with other heat sources.

It is important to keep in mind that exhaust gas is not the only potential source of heat. A system can, for example, be energized by use of a propane or natural gas burner, or other source of heat/energy (solar or industrial). Prospectively, a vehicle can use the cell as the principal source of driving force, and the internal combustion engine is eliminated entirely from the arrangement. Natural gas is of course a plentiful and inexpensive source of energy and is particularly suitable for use in this system for generating steam which can then be used in many energy conversion systems.

Thus the cell is configured and arranged so that it is not a tube with flow of liquid entered at one end and the discharge from the other end but instead the liquid is injected throughout the cell and the discharge is at a suitable location on the cell.

In many cases the outlet vapor is arranged to drive a turbine in a Rankine cycle engine where the vapor from the turbine is condensed to return to a supply tank for the injection liquid. However other energy conversion systems can be used. For example the method of generation of steam herein is particularly suitable for driving a conventional steam piston engine which is more forgiving about changes in temperature and pressure which may arise if the method is not properly controlled.

In one advantageous arrangement, the vapor from the turbine is condensed in a return pipe extending into the supply tank so that the liquid in the supply tank acts to cool the vapor in the pipe while heating the liquid in the tank. The return pipe may include a diffuser for injecting the condensed liquid and or vapor into the liquid in the tank. Generally a radiator or other heat extraction system will be required to remove some of the excess heat to prevent the liquid from boiling in locations where it is intended to be liquid. Typically the radiator is located upstream of the condenser.

The pathway for hot exhaust gases runs through either a single or multiple layers of heat conductive material so as to provide maximum surface contact between zones of heat generation and heat absorption.

In one example, the embodiment consists of two smooth non-concentric tubes situated so that viewed horizontally along its length, the bottom of the larger (exterior) tube is in continuous contact (fused/welded) with the bottom of a smaller (interior) tube. The outer perimeter serves as a containment for steam generated by heat transfer from hot exhaust gases passing through the inner tube, which serves as a main exhaust gas pathway and as a heat transfer medium. In the present embodiment, the entire structure is aluminum. The rate of heat transfer can be modified (increased) by fins extruded along the inner sidewalls of the exhaust gas conduit, and generally oriented so that they project inward towards the center of the tube. Passing hot gases thereby sweep a much larger surface than when passing through a simple smooth tube.

Whereas the inner tube is continuous, the outer is divided into segments (cells). Along any section of the vapor generator, the outer sleeve is sectioned so that for any given exhaust temperature the volume of segments (cells) nearest the hottest exhaust can be balanced with those further downstream. In this manner, while in operation and generating steam as a result of heat transfer, the number of calories per unit of time can be set so that performance as measured by both pressure and steam weight is more or less equalized or balanced across the system. The output of the first cell in a chain of cells leading from an exhaust valve and terminating at a header is therefore approximately equal. The cells nearest the exhaust can have a smaller volume than those further away (downstream). The reason for this adjustability follows. Water is continuously metered and injected at high pressure into each cell. Simultaneously, steam is released in bursts from the cells when pressure has reached the system set point. For example, injection can be 125 psi, while steam release is 110 psi through normally closed pressure relief valves set to open at 110 and close at 105. Normally closed valves build pressure to their high set point, then open only until pressure drops to the low set point.

The steam temperature typically runs between 300 and 400 degrees Fahrenheit. "Recharging" a cell's low set point pressure to high set point release takes only a couple of seconds. In a six cylinder internal combustion engine each exhaust port can carry a group of six cells, resulting in a matrix of 36 cells all set to deliver a 100 psi burst of steam. The result of blending that steam production together and piping it to a turbine is effectively a steady force of 100 psi. The calculated volume of steam measured in pounds of water per hour can exceed 2500 pounds of steam per hour.

Such a volume of steam at that pressure equals the equivalent of 60 shaft horsepower. In the case of the referenced 300 horsepower engine the recovered energy represents a 20% advantage. The integrated system consists of cells, exhaust liner (heat exchanger tube, or core) injection system, pressure relief network, with its steam output at constant pressure blended together to pass a significant volume of steam through a turbine which is harnessed to either a generator or mechanically back into a drive train or other suitable electrical or mechanical device. The steam is continuously condensed and recirculated.

Two applications for the system are stationary power generating stations, such as the common 250 KW units used by the US Military, and as a propane fired substitute for batteries in an electric car.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
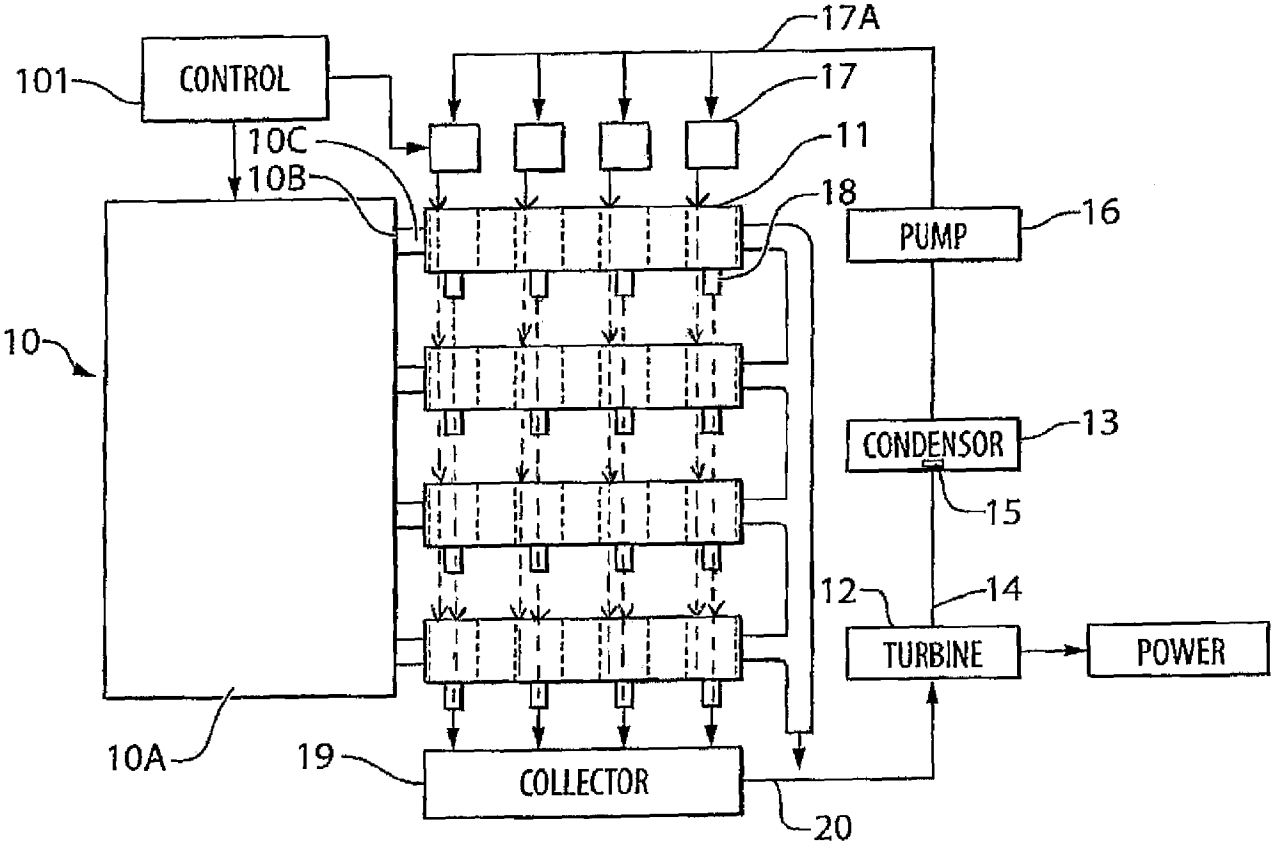
FIG. 1 is a schematic illustration of an apparatus and method for using waste heat from an engine for generating power.

As shown in the Figures there is provided an apparatus and method for evaporating a liquid to generate a pressurized vapor. This comprises a heat source 10 in the form of an engine 10A with exhaust ports 10B feeding exhaust ducts 10C.

At each duct 10C is provided a series of vaporization cells or cores 11 developing steam for a turbine 12 driven by the vapor generated by the cell 11, a return tank 13 for the condensing vapor, a return pipe 14 to carry the steam from the outlet of the turbine which includes a diffuser 15 and a pump 16 to transfer the liquid back to the cell through injectors 17 through lines 17A.

Each cell 11 includes walls defining two spaced surfaces 11C, 11D with an open chamber 11E therebetween with the surfaces located on the inside of walls 11A and 11B.

The walls 11A is in communication with a source of heat from the exhaust 10B within the duct 10C sufficient to maintain the surfaces at a temperature such that the liquid injected by injectors 17 through an inlet nozzle 11E into the chamber is substantially instantly converted to a superheated vapor with no liquid pooling within the chamber and is extracted from the cell by an outlet 11F for the vapor to escape.

The distance D between the surfaces 11C, 11D can be constant but in the arrangement shown is crescent shaped as explained in more detail hereinafter. The cell forms a single chamber without any dividing walls and including side edges 11G, 11H connecting the walls 11A, 11B. The ends are also closed by plates 11J, 11K.

The cell is formed generally into a cylinder where the inner wall 11A is cylindrical to surround the duct 10C and is closed by end plates 11J and 11K described in more detail later. In this case the outlet 11F is formed as a threaded hole in the wall 11D. The injector 17 extends through the outer wall 11B so that the liquid is injected toward the inner wall of the cell within the cell so that it spreads throughout the cell.

In the actual embodiment therefore, the surfaces of the cell are generally parallel but shaped out of a flat plane. Thus the wall 11B including the first cylindrical surface is shaped to follow and surround an exterior of a heat source in the pipe 11P and a second of the surfaces of the cell is generally parallel to the first and shaped to follow the first to define the cell therebetween. The wall 11B in contact with the heat source forms smooth surfaces.

In another arrangement not shown, the cell is formed by casting so that the inner wall follows the required shape and the outer wall forms a shell over the inner wall defining the cell.

Thus the surface is defined by the wall 11B is heated by direct contact with the gas in the pipe 11P at high temperature much greater than 212 degrees F. and preferably greater than 450 degrees F.

The outlet 11F defined by the opening in the wall 11B has an area significantly less than an area defined by a multiple of a width of the cell and the space between the surfaces. Thus the pressure in the cell is greater than 40 psi, preferably greater than 50 and preferably of the order of 100 psi or more.

As shown in FIG. 1, the vapor from the turbine is condensed in the return pipe 14 from the turbine extending into the supply tank so that the liquid in the supply tank acts to cool the vapor in the pipe 14 while heating the liquid in the tank. The pipe includes a vertical section extending into the tank to the bottom and a plurality of legs extending outwardly from the bottom toward the sides of the tank where a diffuser acts for injecting the condensed liquid and or vapor into the liquid in the tank. In most cases a radiator (not shown) is required immediately upstream of the condenser to extract excess heat from the system.

The method disclosed herein for evaporating a liquid to generate a pressurized vapor uses the cells 11 described above including walls 11A and 11B defining two spaced surfaces with an open chamber therebetween. The liquid is injected by injectors 17 for a four cell system on each of the outlet ducts 10C. Thus each cell of the system can include its own injector or as shown the first cells on each duct 10C can be connected to the first injector, the second cells to the second injector etc. This arrangement is used since the first cells on each duct meet the same conditions and the second cells on each duct meet the same conditions etc. The injectors are controlled by the engine control computer 101 of the conventional engine system. The injectors are of a type commercially available for example typically used to inject liquid dispersants into the exhaust of a diesel highway tractor to disperse solid contaminants generated at high power operation. Such injectors are typically piezo-electric in operation and can operate at pressures up to 20,000 psi. Thus the injector can be controlled in operation to turn on and to vary the rate of liquid injection either by directly changing a continuous flow rate or by changing the frequency of a periodic injection. Thus the injector has a frequency of injection which is controlled to provide a required quantity of liquid to prevent the pooling and ensure flash evaporation of all liquid injected while maintaining the amount of water evaporated at or close to a maximum which can be generated from the heat available in the cell. As the input liquid flow is controlled by injectors which are controlled by the engine control computer, these can be operated to supply liquid at a rate dependent on engine parameters as determined by the controller 101.

The surface of at least one of the walls 11A, 11B is in communication with the source of heat generated by the exhaust gases in the duct 10C which is sufficient to maintain the surface and the cell at a temperature such that the liquid injected into the cell is substantially instantly converted to a superheated vapor with no liquid pooling within the chamber.

The outlet 11F formed by the screw-threaded opening from the cell allows the vapor to escape. The pressure in the cell is maintained greater than 40 psi, preferably greater than 50 and preferably greater than 100 psi. In order to control the flow of vapor to maintain the required back pressure there is provided on each cell a relief valve 18 downstream of the outlet which acts to maintain the pressure. The relief valve is responsive to pressure in the cell so that the valve opens and closes at a rate to maintain the pressure between an upper value when the valve opens and a lower value when the valve closes. The values can be of the order of 110 psi and 90 psi to maintain the pressure at a nominal 100 psi. These values can be selected in a manner which operates the valve at period of the order of 1 to 2 seconds. As stated above, the relief valve is arranged to control release pressure and temperature in the cell so that no liquid is present in the cell. That is the flow rate escaping is sufficient to prevent accumulation of vapor sufficient to prevent all liquid from evaporating. The back pressure maintained in the cells ensures that the collected vapor is also at the same pressure as it departs the outlets and moves to a common collector 19 supplying the turbine. This pressure is selected to be suitable for or designed to match the turbine 12. In this embodiment as shown there are sixteen cells but this number can of course vary depending on the amount of heat available for extraction and bearing in mind the necessity to collect the periodic cell production into a continuous stream. Thus the output from the plurality of cells is connected together and collected at the common collector 19 which can be a simple pipe. The back pressure valve of each cell operates at a rate determined by the pressure in the cell to generate periodic bursts of vapor and the output from the cells is collected to form a continuous stream at the outlet 20 from the collector 19.

In the embodiment shown, the source of heat comprises a multiple cylinder internal combustion engine 10 with a plurality of exhaust ducts 10C and the sixteen cells arranged in series of four sequentially on each exhaust duct 12. As explained previously, the input liquid flow is controlled by injectors where each injector supplies liquid to a plurality of cells at common position on the ducts.

Inside the duct 10C there are provided elements for controlling heat transfer from the duct to each cell where the elements are arranged so as to increase heat transfer to subsequent cells on same exhaust duct. Thus in FIGS. 2 and 3, the first cell 111 has the interior of the duct without any heat transfer elements in the interior so that the duct is clear or smooth at the surface 115.

As shown in FIG. 2 and FIGS. 3, 4 and 5, the further cell 112, 113 and 114 have elements within the duct and inside the inner wall for controlling heat transfer from the gas in the duct to the inner wall. Thus the elements are arranged such that the heat transfer of the cells is different from the heat transfer at the other cells with the intention to balance the heat applied to the cells bearing in mind that the heat available in the duct decreases along the duct, thus requiring an increase in heat transfer.

Figure 2:
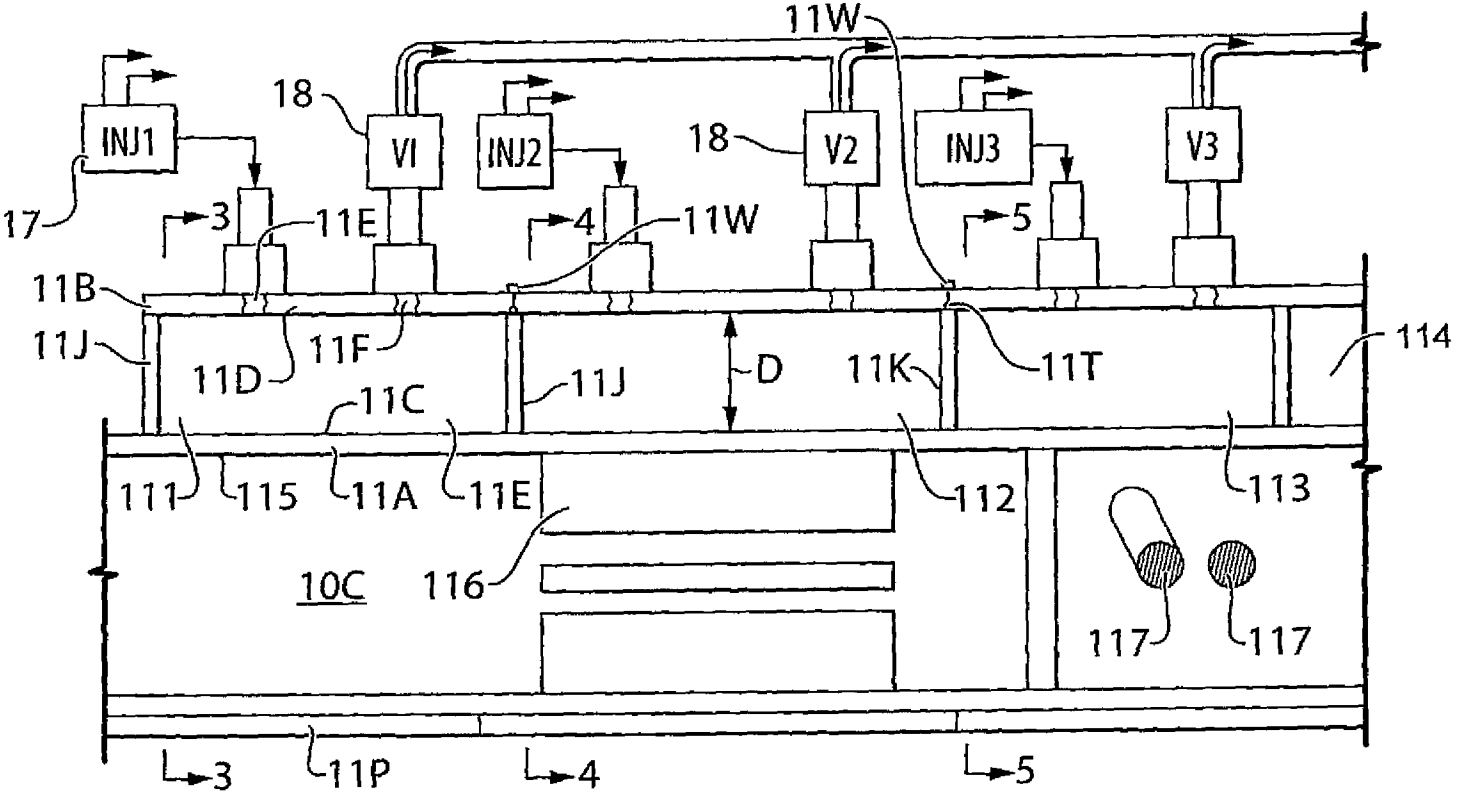
FIG. 2 is a longitudinal cross-sectional view of one exhaust duct of FIG. 1 showing three cells on the duct.
Figure 4:
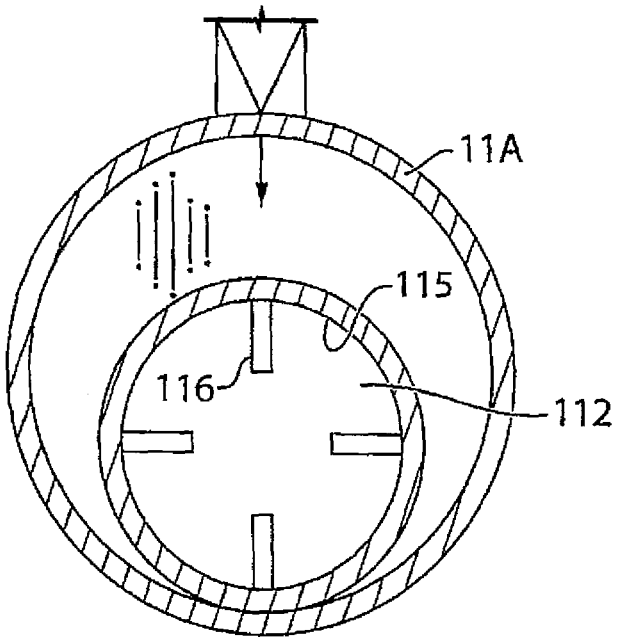

Thus in FIGS. 2 and 4, the elements 116 within the duct comprise longitudinally extending fins mounted on the inner wall at angularly spaced positions around the axis of the duct 115 and extending inwardly therefrom so as to transfer heat conductively to the surface 115.

Figure 5:
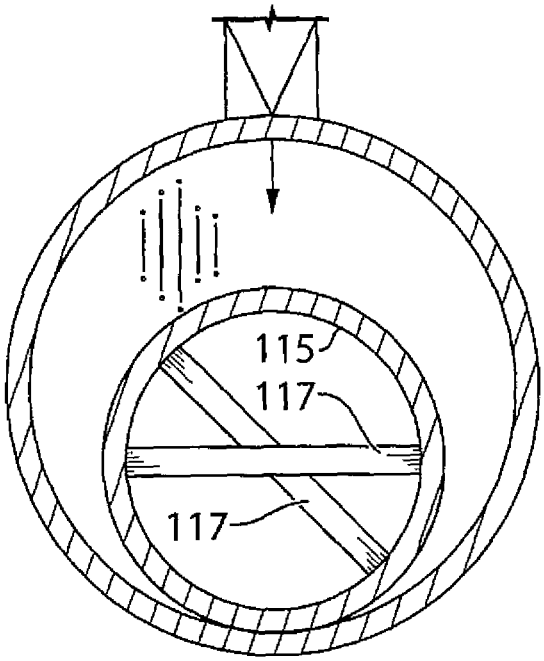

Thus in FIGS. 2 and 5, the elements 117 within the duct the elements within the duct comprise bars bridging the duct and connected at each end to the inner wall. The bars can be cylindrical and are arranged diametrically across the duct at spaced positions along the duct and can be rotated each from the next at a different angle so as to disturb the flow through the duct and transfer heat conductively to the surface 115.

Figure 6:
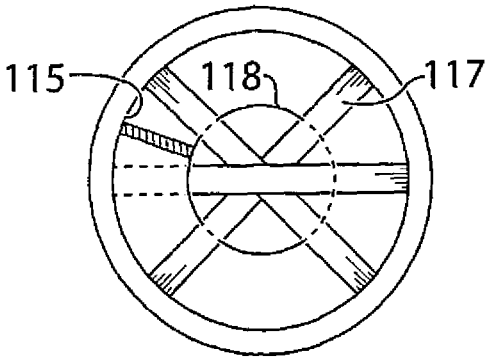
FIG. 6 is a cross sectional view similar to FIGS. 3, 4 and 5 showing an alternative form of the baffles.

Thus in FIG. 6, the elements within the duct include a twisted or helical fin 118 formed by rotating the tube around its axis as it is extruded, together with additional transverse bars 117 bridging the inner surface within the tube. Thus this arrangement obtains the combined effect of the transverse disturbance bars and the fins which transfer heat to the inside surface.

Figure 3:
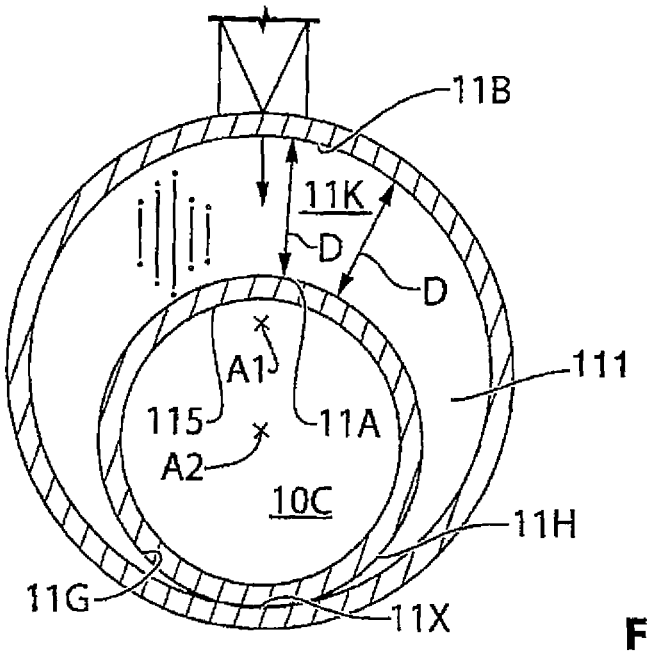
FIGS. 3, 4 and 5 are cross-sectional views along the lines 3-3, 4-4 and 5-5 of FIG. 2.

As shown in FIGS. 2 and 3, the cells are arranged such that the outer wall 11B has its axis A1 axially offset from the axis A2 of the inner wall so that an inside surface 11D of the outer wall 11B is in contact with an outside surface 11C of the inner wall 11A at one side 11X of the inner and outer walls with an opposite side of the outer wall 11B spaced by the distance D. The outer wall of each cell is formed from a cylindrical wall portion 11P wrapped around the inner wall forming the duct and welded along the touching bottom portion 11X. Each cell has a separate portion 11P and these are connected at crescent shape divider members 11J, 11K matching the shape of the cell. The cells are formed by welding the circular inner edge of the divider member to the inner wall 11A, by engaging the outer portion 11P around the inner wall and welding its end edges at weld beads 11T to the divider walls 11J, 11K. The next portion 11P is then welded around the outer edge to the first portion at weld bead 11W.

It will be appreciated that neither the inner wall 11A nor the outer wall 11B need to be circular in cross section. In this case the walls 11J and 11K are not crescent shaped but are instead shaped to match the space between the walls 11A and 11B which may be complex in shape. It is however desirable that at some location around the periphery of the inner wall 11A there is contact with the wall 11B to ensure conduction transfer of heat between the walls to reduce the possibility of liquid pooling.

The system operates as follows, using the process steps 1 to 12 shown in FIG. 1:

1. The heat source 10 is a hot exhaust electricity, gas or any high temperature source that will super heat the vaporization core.

2. Pressurized water is injected by injector 17 into the super heated vaporization cell 11.

3. The vaporization cell 11 can be any shape. Instead of generating steam in traditional low volume tubes, the thin high volume design vaporizes water instantly as it is injected into the super-heated cell. It allows for variable low or high volume instant vaporization from water to steam.

4. Super-heated steam is exhausted through the turbine 12 at variable pressures related to the temperature of the vaporization cell and the volume of water being injected. Vaporization efficiency also increases as the water becomes preheated on the return exhaust cycle to the non-pressurized holding tank 13.

5. A pre-condensate return system may be provided to take non-vaporized water directly back to the holding/preheating tank via high pressure or a mechanical pump. The system can be used to keep "swamping" from occurring in the vaporization cell. However the back pressure and timed release of the vapor obtained by the valve is used to maintain the cell liquid free.

6. Steam is forced through the turbine 12 which turns an electric generator or other mechanical devices.

7. Exhausted steam from the turbine 12 is immediately returned to the holding tank 13 for re-use and to preheat the supply.

8. The holding and pre-heating tank collects the high pressure steam through a "diffuser" 15 which is located at the bottom of the tank's total water volume. By forcing the diffused steam through the high volume, non-pressurized condensate allows for a quicker return of steam to water while pre-heating the overall water supply at the same time. A radiator is provided to extract excess heat.

9. The high pressure steam tank diffuser 15 slows and disperses the delivery of the steam back into the bottom of the holding tank. It forces the exhaust to slow and to start condensing before entering the tank.

10. Water from the holding tank 13 is pumped or forced to the vaporization chamber via the use of a mechanical pump or pressurized air 16. An injector can also be provided which is fed by the pump and injects the liquid at high pressure and controlled rate.

11. A compressed air system or an electric, mechanical pump 16 forces water from the holding tank to the pressure regulated injectors into the vaporization cell.

12. Pressurized and regulated water injection line(s) 17A feeds injectors 17 and vaporization cell 11.

The invention claimed is:

1. A method for evaporating water to generate pressurized steam comprising:

passing a heated gas through a duct along a longitudinal direction of the duct from a feed end of the duct to a discharge end of the duct;

the duct including a duct wall surrounding an axis of the duct with the duct wall extending continuously in the longitudinal direction from the feed end at one longitudinal end of the duct to the discharge end at the other end of the longitudinal duct;

a peripheral wall surrounding the duct at a position on the duct between the feed end and the discharge end defining a chamber between the peripheral wall and the duct wall;

the chamber being divided by plurality of divider walls extending transverse to the axis of the duct and arranged at axially spaced positions along the axis of the duct so as to divide the chamber into a plurality of axially separated cells arranged end to end along the duct;

each divider wall having an inner edge in engagement with the duct wall and an outer edge in engagement with the peripheral wall so that each cell is separated from a next adjacent cell by a respective one of the divider walls to prevent the passage of steam from one cell to the next adjacent cell;

injecting the water as a water spray into each of the cells through an injector nozzle mounted in the peripheral wall directed into the chamber from the peripheral wall toward an outside surface of the duct wall;

causing the water spray injected into the chamber to be converted substantially instantaneously to steam with no water pooling within the chamber by maintaining a required pressure within the chamber and by maintaining the heated gas inside the duct at a required temperature;

and collecting the steam from a separate outlet provided for each of the cells for the steam to escape.

2. The method according to claim 1 wherein the temperature in each cell is greater than 250 degrees F. so as to generate superheated steam instantly.

3. The method according to claim 1 wherein the pressure in each cell is maintained greater than 40 psi.

4. The method according to claim 1 wherein the water is injected periodically at a frequency of injection which is controlled to provide a required quantity of water.

5. The method according to claim 1 wherein there is provided a relief valve downstream of each outlet which acts to maintain the pressure within the respective cell.

6. The method according to claim 1 wherein the source of heat comprises a multiple cylinder internal combustion engine with a plurality of exhaust ducts each forming a respective duct and wherein there is provided a plurality of cells arranged sequentially on each of the respective exhaust ducts.

7. A method for evaporating water to generate pressurized steam comprising:

passing a heated gas through a duct along a longitudinal direction of the duct from a feed end of the duct to a discharge end of the duct;

the duct including a duct wall surrounding an axis of the duct with the duct wall extending continuously in the longitudinal direction from the feed end at one longitudinal end of the duct to the discharge end at the other end of the longitudinal duct;

a peripheral wall surrounding the duct at a position on the duct between the feed end and the discharge end defining a chamber between the peripheral wall and the duct wall;

the chamber being divided by plurality of divider walls extending transverse to the axis of the duct and arranged at axially spaced positions along the axis of the duct so as to divide the chamber into a plurality of axially separated cells arranged end to end along the duct;

each divider wall having an inner edge in engagement with the duct wall and an outer edge in engagement with the peripheral sleeve so that each cell is separated from a next adjacent cell by a respective one of the divider walls to prevent the passage of steam from one cell to the next adjacent cell;

injecting the water as a water spray into each of the cells through an injector nozzle mounted in the peripheral wall directed into the chamber from the peripheral wall toward an outside surface of the duct wall;

causing the water spray injected into the chamber to be converted substantially instantaneously to steam with no water pooling within the chamber by maintaining a required pressure within the chamber and by maintaining the heated gas inside the duct at a required temperature;

and collecting the steam from a separate outlet provided for each of the cells for the steam to escape;

wherein the peripheral wall is axially offset from the duct wall so that a portion of an inside surface of the peripheral wall extending longitudinally along the peripheral wall is in contact with a portion of an outside surface of the duct wall extending longitudinally along the duct wall.

8. A method for evaporating water to generate pressurized steam comprising:

passing a heated gas through a duct along a longitudinal direction of the duct from a feed end of the duct to a discharge end of the duct;

the duct including a duct wall surrounding an axis of the duct with the duct wall extending continuously in the longitudinal direction from the feed end at one longitudinal end of the duct to the discharge end at the other end of the longitudinal duct;

a peripheral wall surrounding the duct at a position on the duct between the feed end and the discharge end defining a chamber between the peripheral sleeve and the duct wall;

the chamber being divided by plurality of divider walls extending transverse to the axis of the duct and arranged at axially spaced positions along the axis of the duct so as to divide the chamber into a plurality of axially separated cells arranged end to end along the duct;

each divider wall having an inner edge in engagement with the duct wall and an outer edge in engagement with the peripheral wall so that each cell is separated from a next adjacent cell by a respective one of the divider walls to prevent the passage of steam from one cell to the next adjacent cell;

injecting the water as a water spray into each of the cells through an injector nozzle mounted in the peripheral wall directed into the chamber from the peripheral wall toward an outside surface of the duct wall;

causing the water spray injected into the chamber to be converted substantially instantaneously to steam with no water pooling within the chamber by maintaining a required pressure within the chamber and by maintaining the heated gas inside the duct at a required temperature;

collecting the steam from a separate outlet provided for each of the cells for the steam to escape;

and transferring heat using heat conducting elements within the duct conducting heat to each cell;

wherein a first cell includes first heat conducting elements and a second subsequent cell includes second heat conducting elements;

and wherein the first and second heat conducting elements are arranged such that an amount of heat transferred by the first conducting elements within the duct to the first cell is less than that transferred by the second conducting elements within the duct to the second subsequent cell.

9. The method according to claim 8 wherein the heat conducting elements within the duct comprise fins mounted on the duct wall and extending inwardly therefrom.

10. The method according to claim 8 wherein the heat conducting elements within the duct wall comprise bars bridging the duct wall and connected at each end to the duct wall.

* * * * *